US011674749B2

(12) United States Patent
Vovard et al.

(10) Patent No.: US 11,674,749 B2
(45) Date of Patent: Jun. 13, 2023

(54) LNG PRODUCTION WITH NITROGEN REMOVAL

(71) Applicant: Air Products and Chemicals, Inc., Allentown, PA (US)

(72) Inventors: Sylvain Vovard, Louveciennes (FR); Justin David Bukowski, Lenhartsville, PA (US); Fei Chen, Whitehouse Station, NJ (US); Mark Julian Roberts, Whitehall, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 497 days.

(21) Appl. No.: 16/818,168

(22) Filed: Mar. 13, 2020

(65) Prior Publication Data

US 2021/0285721 A1 Sep. 16, 2021

(51) Int. Cl.

| | |
|---|---|
| ***F25J 3/02*** | (2006.01) |
| ***F25J 1/00*** | (2006.01) |
| ***F25J 3/08*** | (2006.01) |

(52) U.S. Cl.

CPC ..... *F25J 3/0257* (2013.01); *F25J 1/0015* (2013.01); *F25J 1/0022* (2013.01); *F25J 3/0209* (2013.01); *F25J 3/08* (2013.01); *F25J 2200/72* (2013.01); *F25J 2200/74* (2013.01); *F25J 2210/42* (2013.01); *F25J 2210/60* (2013.01); *F25J 2230/04* (2013.01); *F25J 2230/42* (2013.01); *F25J 2230/60* (2013.01); *F25J 2245/42* (2013.01)

(58) Field of Classification Search

CPC ..... F25J 1/0219; F25J 1/0264; F25J 1/0262; F25J 1/0208; F25J 1/0015; F25J 1/004; F25J 3/0257; F25J 2200/76; F25J 2270/42

See application file for complete search history.

(56) References Cited

U.S. PATENT DOCUMENTS

| | | | | |
|---|---|---|---|---|
| 9,816,754 | B2 | 11/2017 | Chen et al. | |
| 9,945,604 | B2 | 4/2018 | Ott et al. | |
| 2011/0226009 | A1* | 9/2011 | Paradowski | F25J 1/0208 62/613 |
| 2012/0090355 | A1* | 4/2012 | Johnson | F25J 3/0209 62/618 |
| 2012/0285196 | A1 | 11/2012 | Flinn et al. | |
| 2015/0308736 | A1* | 10/2015 | Chen | F25J 3/0233 62/623 |
| 2016/0313057 | A1 | 10/2016 | Roberts et al. | |
| 2019/0346203 | A1 | 11/2019 | Chen et al. | |
| 2020/0103166 | A1* | 4/2020 | Bauer | F25J 3/0209 |

FOREIGN PATENT DOCUMENTS

| | | |
|---|---|---|
| CN | 1293232 | 5/2001 |
| CN | 105462640 | 4/2016 |
| DE | 102014010103 | 1/2016 |
| JP | 2013036676 | 2/2013 |

* cited by examiner

*Primary Examiner* — Brian M King
(74) *Attorney, Agent, or Firm* — Amy C. Trexler

(57) ABSTRACT

A method and system for liquefying a natural gas feed stream and removing nitrogen therefrom.

20 Claims, 5 Drawing Sheets

LNG PRODUCTION WITH NITROGEN REMOVAL

BACKGROUND

The present invention relates to a method for liquefying a natural gas feed stream and removing nitrogen therefrom. The present invention also relates to a system (such as for example a natural gas liquefaction plant or other form of processing facility) for liquefying a natural gas feed stream and removing nitrogen therefrom.

In processes for liquefying natural gas it is often desirable or necessary, for example due to purity and/or recovery requirements, to remove nitrogen from the feed stream while minimizing product (methane) loss. Typical commercial liquid natural gas (LNG) product specifications often include a requirement that the nitrogen content is about 1% or less, so that the LNG can be stored with reduced concern for tank rollover.

Traditionally, LNG has been produced in plants that use gas or steam turbines directly connected to refrigerant compressors to provide power for liquefaction. In this case, nitrogen could be rejected from the product LNG by flashing the LNG from the liquefier at a low pressure into vapor and liquid phases such that the resulting vapor enriched in nitrogen is used as fuel for steam generation or the gas turbines, and the resulting liquid depleted in nitrogen meets LNG product specifications.

However, with increasing use of more efficient gas turbines and the use of electric motors to drive the refrigeration compressors, the fuel demand for newer LNG plants is often quite low. In such circumstances excess nitrogen in the natural gas feed has to be vented to the atmosphere or otherwise used or exported as a nitrogen product. If vented, the nitrogen typically has to meet strict purity specifications (e.g., >95 mol %, or >99 mol %), due to environmental concerns and/or due to methane recovery requirements. The same is of course true if the nitrogen is to be used or exported as a high purity nitrogen product. Such purity requirements pose separation challenges. In the case of a very high nitrogen concentration (typically greater than 10 mol %, in some cases up to or even higher than 20 mol %) in the natural gas feed, a dedicated nitrogen rejection unit (NRU) proves to be a robust method to remove nitrogen efficiently and produce a pure (>99 mol %) nitrogen product. In most cases, however, natural gas contains about 1 to 10 mol % nitrogen. When the nitrogen concentration in the feed is within this range, the applicability of the NRU is hindered by the high capital cost due to complexity associated with the additional equipment.

U.S. Pat. No. 9,945,604 discloses a simple, efficient process that is capable of removing nitrogen even from natural gas feeds with relatively low nitrogen concentrations. In the process disclosed in FIG. 1 of this document, the natural gas feed stream is cooled and liquefied in a main heat exchanger against a vaporizing mixed refrigerant, the resulting LNG stream exiting the main heat exchanger at a temperature of around −240° F. (−150° C.). The LNG stream is then further cooled in a reboiler heat exchanger, which provides heat for boilup for a distillation column, before being introduced into the distillation column at an intermediate location of said column and separated into a nitrogen enriched overhead vapour and a nitrogen depleted bottoms liquid. A stream of the bottoms liquid is withdrawn as a nitrogen depleted LNG product. A stream of the overhead vapour is warmed to near ambient temperature in an overhead heat exchanger and then divided into two portions, namely a rejected nitrogen stream which is vented to the atmosphere, and a recycle stream which is compressed to a high pressure and then cooled and condensed in the overhead heat exchanger to provide reflux to the distillation column. In order to improve the cooling curves in the overhead heat exchanger, and thus the efficiency of the process, a portion of the mixed refrigerant that is used in the main heat exchanger is also used to provide refrigeration to the overhead heat exchanger.

FIG. 10 of U.S. Pat. No. 9,816,754 depicts a similar arrangement to that shown in FIG. 1 of U.S. Pat. No. 9,945,604, in which overhead nitrogen is recycled to the distillation column to provide reflux to the distillation column, with additional refrigeration to the overhead heat exchanger being supplied by a portion of the mixed refrigerant that is used in the main heat exchanger. The main difference between FIG. 10 of U.S. Pat. No. 9,816,754 and FIG. 1 of U.S. Pat. No. 9,945,604 is that in FIG. 10 of U.S. Pat. No. 9,816,754 the feed to the distillation column is provided from a boiloff gas stream from the LNG storage tank which is first compressed and recycled through the main exchanger where it is condensed before being sent to the distillation column.

FIG. 3 of U.S. Pat. No. 9,816,754 depicts an alternative process in which boiloff gas from the LNG storage tank is condensed in the main exchanger and used to provide reflux to the distillation column. While this arrangement allows for some enrichment of the overhead stream from the distillation column in nitrogen, the achievable nitrogen purity of this process is limited by the fact that the reflux stream has the same composition as the boil off gas stream. This vapor is in equilibrium with the LNG in the tank and will necessarily contain a large amount of methane.

While the configurations of U.S. Pat. No. 9,816,754 FIG. 10 and U.S. Pat. No. 9,945,604 can produce high purity rejected nitrogen, the arrangements shown in these figures also exhibit certain design and operational difficulties and complexities, related to the use of a two-phase refrigerant and multiple streams of refrigerant in the overhead heat exchanger.

Accordingly, there remains a need in the art for methods and systems that can, in a simple and efficient manner, remove nitrogen from and liquefy a natural gas feed stream to produce a nitrogen depleted LNG product.

BRIEF SUMMARY

Disclosed herein are methods and systems liquefying nitrogen containing natural gas while simultaneously separating and removing nitrogen therefrom in a simple and efficient manner, such that the LNG product can contain low amounts of nitrogen (typically 1% or lower nitrogen) and such that the rejected nitrogen can be pure enough for venting to the atmosphere or for use as a high purity nitrogen product (typically 99% nitrogen or purer). Said methods and systems allow for efficient rejection of nitrogen from the LNG product at low cost, and are in particular useful for plants where there is a low internal or external fuel demand (via which the nitrogen could otherwise be rejected).

Several preferred aspects of the systems and methods according to the present invention are outlined below.

Aspect 1: A method for liquefying a natural gas feed stream and removing nitrogen therefrom, the method comprising:

(a) passing a nitrogen containing natural gas feed stream through a main heat exchanger and cooling and liquefying the natural gas stream in the main heat exchanger via indirect heat exchange with a first refrigerant, thereby producing a first LNG stream;

(b) withdrawing the first LNG stream from the main heat exchanger;

(c) expanding the first LNG stream and introducing said stream into a distillation column in which the stream partially vaporizes and is separated into a nitrogen enriched overhead vapor and a nitrogen depleted bottoms liquid;

(d) withdrawing a stream of the nitrogen depleted bottoms liquid from the distillation column to form a second, nitrogen depleted, LNG stream;

(e) warming a stream of the nitrogen enriched overhead vapor in an overhead heat exchanger to form a warmed overhead vapor;

(f) compressing, cooling and liquefying, subcooling and expanding a recycle stream formed from a first portion of the warmed overhead vapor to form a liquid or two-phase recycle stream and introducing said liquid or two-phase recycle stream into the distillation column to provide reflux to the distillation column;

(h) forming one or more nitrogen product streams or vent streams from a second portion of the warmed overhead vapor;

wherein in step (f) at least a portion of the recycle stream is liquefied via indirect heat exchange with the first refrigerant by passing said at least a portion of the recycle stream through the main heat exchanger, separately from the natural gas feed stream;

wherein in step (f) the recycle stream is subcooled via indirect heat exchange with the nitrogen enriched overhead vapor by passing a least a portion of the recycle stream through the overhead heat exchanger; and wherein the overhead heat exchanger is separate from the main heat exchanger, and all of the cooling duty for the overhead heat exchanger is provided by the warming of the stream of the nitrogen enriched overhead vapor in step (e).

Aspect 2: The method of Aspect 1, wherein the overhead heat exchanger is a coil wound heat exchanger comprising one or more tube bundles contained within a shell and defining a tube side and a shell of the heat exchanger, wherein in step (e) the stream of the nitrogen enriched overhead vapor passes through and is warmed in the shell side of the overhead heat exchanger, and wherein in step (f) the recycle stream is subcooled by passing a least a portion of the recycle stream through the tube side of the overhead heat exchanger.

Aspect 3: The method of Aspect 2, wherein the overhead heat exchanger is integrated with the distillation column, with the one or more tube bundles being located within the top of the distillation column and with the shell of the overhead heat exchanger forming the top part of the distillation column shell.

Aspect 4: The method of any one of Aspects 1 to 3, wherein the overhead heat exchanger comprises a warm heat exchanger section and a cold heat exchanger section, and wherein in step (f) the recycle stream is subcooled by passing a least a portion of the recycle stream through the cold heat exchanger section.

Aspect 5: The method of Aspect 4, wherein in step (f) a portion or all of the recycle stream is cooled by passing said portion or all of the recycle stream through the warm heat exchanger section.

Aspect 6: The method of Aspect 4 or 5, wherein one or more streams of natural gas or first refrigerant are cooled by passing said stream(s) through the warm heat exchanger section.

Aspect 7: The method of any one of Aspects 1 to 6, wherein in step (f) all of the recycle stream is liquefied via indirect heat exchange with the first refrigerant by passing said stream through the main heat exchanger to form a liquefied recycle stream.

Aspect 8: The method of Aspect 7, wherein in step (f) the recycle stream is subcooled by passing all of the liquefied recycle stream through the overhead heat exchanger.

Aspect 9: The method of Aspect 7, wherein in step (f) the recycle stream is subcooled by passing a first portion of the liquefied recycle stream through the overhead heat exchanger to form a subcooled portion, wherein a second portion of the liquefied recycle stream bypasses the overhead heat exchanger and is then mixed with the subcooled portion, and wherein the subcooled portion and second portion are expanded prior to or after being mixed, so as to form the liquid or two-phase recycle stream that provides reflux to the distillation column.

Aspect 10: The method of any one of Aspects 1 to 6, wherein in step (f) a first portion of the recycle stream is liquefied via indirect heat exchange with the first refrigerant by passing said first portion of the recycle stream through the main heat exchanger to form a first liquefied portion, and a second portion of the recycle stream is liquefied and subcooled by being passed through the overhead heat exchanger to form a second liquefied and subcooled portion, wherein the the first liquefied portion and second liquefied and subcooled portion are then mixed, and wherein the first liquefied portion and second liquefied and subcooled portion are expanded prior to or after being mixed, so as to form the liquid or two-phase recycle stream that provides reflux to the distillation column.

Aspect 11: The method of any one of Aspects 1 to 10, wherein the first LNG stream is introduced in step (c) into the distillation column at an intermediate location of the distillation column.

Aspect 12: The method of Aspect 11, wherein step (c) further comprises cooling the first LNG stream in a reboiler heat exchanger prior to introducing the first LNG stream into the distillation column; and wherein the method further comprises warming and vaporizing a portion of the nitrogen depleted bottoms liquid in the reboiler heat exchanger, via indirect heat exchange with the first LNG stream, so as to provide boilup to the distillation column.

Aspect 13: The method of any one of Aspects 1 to 12, wherein in step (b) the first LNG stream is withdrawn from the cold end of the main heat exchanger, and wherein in step (f) the at least a portion of the recycle stream that is liquefied in the main heat exchanger is withdrawn from the cold end of the main heat exchanger.

Aspect 14: The method of any one of Aspects 1 to 13, wherein in step (b) the first LNG stream is withdrawn from the main heat exchanger at a temperature of about 220 to 250° F. (about 140 to −155° C.).

Aspect 15: The method of any one of Aspects 1 to 14, wherein in step (f) the at least a portion of the recycle stream that is liquefied in the main heat exchanger is withdrawn from the main heat exchanger at a temperature of about −220 to −250° F. (about 140 to −155° C.).

Aspect 16: The method of any one of Aspects 1 to 15, wherein the nitrogen enriched overhead vapor enters the cold end of the overhead heat exchanger at a temperature of about −300 to −320° F. (−185 to −195° C.).

Aspect 17: The method of any one of Aspects 1 to 16, wherein the first refrigerant is a refrigerant that is vaporized as it is passed through the main heat exchanger to provide the cooling duty for liquefying the natural gas stream in the main heat exchanger in step (a) and for liquefying the at least a portion of the recycle stream in the main heat exchanger in step (f).

Aspect 18: The method of Aspect 17, wherein in step (f) the recycle stream is compressed to a pressure such that the at least a portion of the recycle stream that is liquefied inside the main heat exchanger finishes liquefying at a temperature that is from 0 to 10° F. (0 to 5° C.) higher than the temperature at which the first refrigerant starts to vaporize inside the main heat exchanger.

Aspect 19: A system for liquefying a natural gas feed stream and removing nitrogen therefrom, the system comprising:

a main heat exchanger having a warm side comprising one or more passages for receiving a nitrogen containing natural gas feed stream and a cold side comprising one or more passages for receiving a stream of a first refrigerant, the warm and cold sides being configured such that when the nitrogen containing natural gas feed stream is passed through the warm side it is cooled and liquefied by indirect heat exchange with the stream of the first refrigerant passing through the cold side, thereby producing a first LNG stream;

a first refrigerant circuit, for supplying a cooled stream of the first refrigerant to the cold side of the main heat exchanger and withdrawing a warmed stream of the first refrigerant stream from the cold side of the main heat exchanger;

an expansion device in fluid flow communication with the main heat exchanger for receiving and expanding the first LNG stream;

a distillation column in fluid flow communication with the expansion device for receiving the first LNG stream from the expansion device, the first LNG stream being partially vaporized and separated inside the distillation column into a nitrogen enriched overhead vapor and a nitrogen depleted bottoms liquid;

a conduit for withdrawing a stream of the nitrogen depleted bottoms liquid from the distillation column to form a second, nitrogen depleted, LNG stream;

an overhead heat exchanger having cold side comprising one or more passages for receiving a stream of the nitrogen enriched overhead vapor and a warm side comprising one or more passages, the warm and cold sides being configured such that nitrogen enriched overhead vapor passing through the cold side is warmed by indirect heat exchange with fluid passing through the warm side, thereby producing a warmed overhead vapor;

a reflux circuit for compressing, cooling and liquefying, subcooling and expanding a recycle stream formed from a first portion of the warmed overhead vapor to form a liquid or two-phase recycle stream and for introducing said liquid or two-phase recycle stream into the distillation column to provide reflux to the distillation column;

one or more conduits for withdrawing from the system one or more nitrogen product streams or vent streams formed from a second portion of the warmed overhead vapor;

wherein the reflux circuit is configured to liquefy said at least a portion of the recycle stream via indirect heat exchange with the first refrigerant by passing said at least a portion of the recycle stream through one or more passages in the warm side of the main heat exchanger, separately from the natural gas feed stream;

wherein the reflux circuit is configured to subcool the recycle stream via indirect heat exchange with the nitrogen enriched overhead vapor by passing at least a portion of the recycle stream through one or more of said passages in the warm side of the overhead heat exchanger; and wherein the overhead heat exchanger is separate from the main heat exchanger, and the system is configured such that the stream of nitrogen enriched overhead vapor is the only stream that passes through the cold side of the overhead heat exchanger and so provides all of the cooling duty for the overhead heat exchanger.

Aspect 20: A system according to Aspect 19, wherein the overhead heat exchanger is a coil wound heat exchanger comprising one or more tube bundles contained within a shell and defining a tube side and a shell of the heat exchanger, wherein the shell side is the cold side of the heat exchanger and wherein the tube side is the warm side of the heat exchanger.

DETAILED DESCRIPTION

Figure 1:
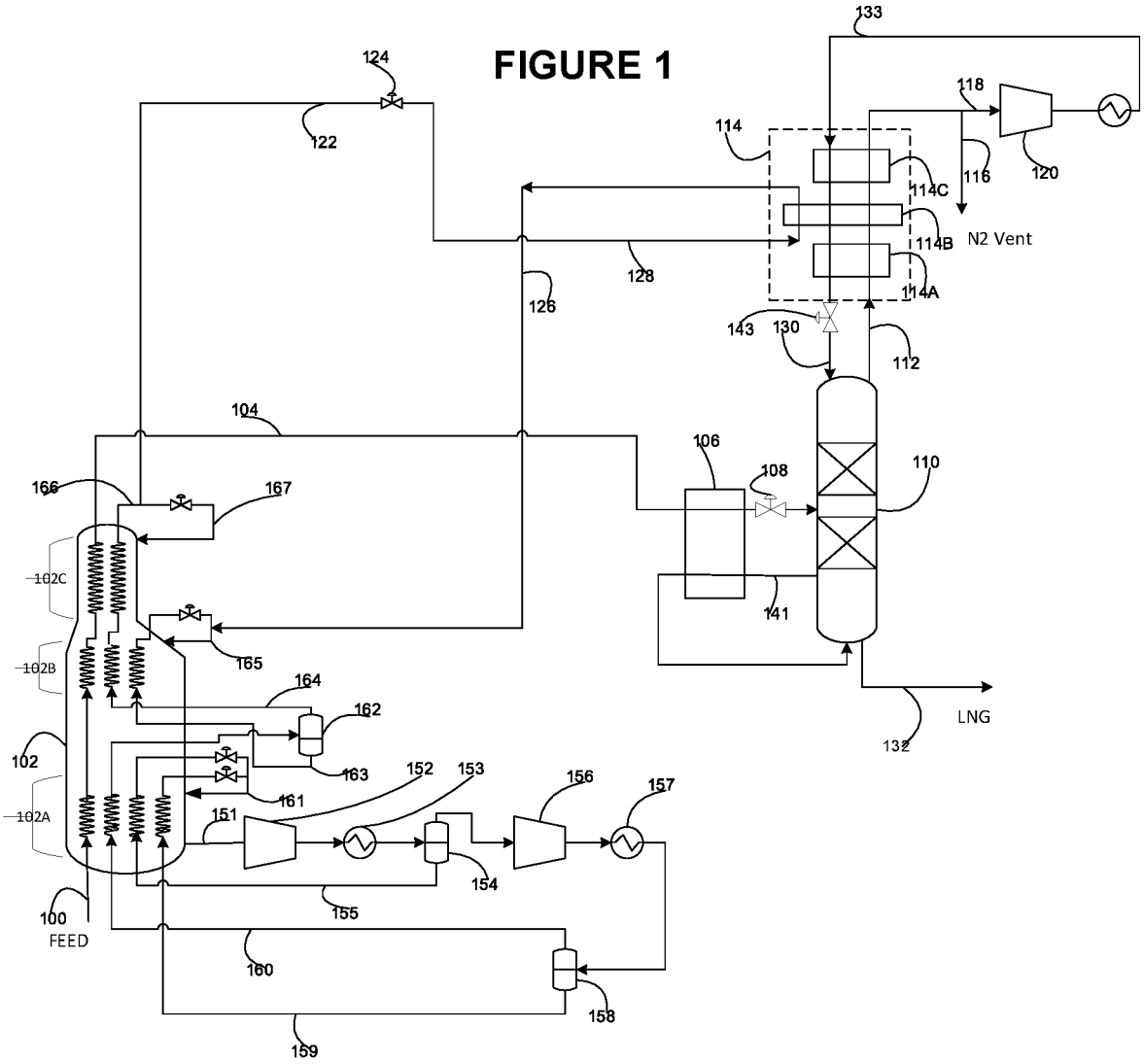
FIG. 1 is a schematic flow diagram depicting a comparative method and system, not in accordance with the present invention, for liquefying and removing nitrogen from a natural gas stream.

As used herein and unless otherwise indicated, the articles "a" and "an" mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

Where letters are used herein to identify recited steps of a method (e.g. (a), (b), and (c)), these letters are used solely to aid in referring to the method steps and are not intended to indicate a specific order in which claimed steps are performed, unless and only to the extent that such order is specifically recited.

Unless otherwise stated, any and all percentages referred to herein should be understood as indicating mole percent. Unless otherwise stated, any and all pressures referred to herein should be understood as indicating absolute pressure (gauge pressure plus atmospheric pressure).

Where used herein to identify recited features of a method or system, the terms "first", "second", "third" and so on, are used solely to aid in referring to and distinguishing between the features in question, and are not intended to indicate any specific order of the features, unless and only to the extent that such order is specifically recited.

As used herein, the term "natural gas feed stream" encompasses also gases and streams comprising synthetic and/or substitute natural gases, as well as recycled natural gas streams such as a stream comprising or consisting of boil-off gas from an LNG storage tank. The major component of natural gas is methane, and the natural gas feed stream is typically at least 85%, and more often at least 90% methane. As is self-apparent, a "nitrogen containing natural gas feed stream" is a natural gas stream that contains also nitrogen, and will typically have a nitrogen concentration of from 1 to 10%. Other typical components of raw or crude natural gas that may be present in the feed stream in smaller amounts include other, heavier hydrocarbons (such as ethane, propane, butanes, pentanes, etc.), helium, hydrogen, carbon dioxide and/or other acid gases, and mercury. However, the natural gas feed stream that is passed through and cooled and liquefied in the main heat exchanger will have been pretreated if and as necessary to reduce the levels of any (relatively) high freezing point components, such as moisture, acid gases, mercury and/or heavier hydrocarbons, down to such levels as are necessary to avoid freezing or other operational problems in the main heat exchanger.

As used herein, and unless otherwise indicated, a stream or vapor is "nitrogen-enriched" if the concentration of nitrogen in the stream or vapor is higher than the concentration of nitrogen in the nitrogen containing natural gas feed stream. A stream or vapor is "nitrogen-depleted" if the concentration of nitrogen in the stream or vapor is lower than the concentration of nitrogen in the nitrogen containing natural gas feed stream.

As used herein, the term "indirect heat exchange" refers to heat exchange between two fluids where the two fluids are kept separate from each other by some form of physical barrier.

As referred to herein, the term "heat exchanger" refers to any device or system in which indirect heat exchange is taking place between two or more streams. Unless otherwise indicated, the heat exchanger may be composed of one or more heat exchanger sections arranged in series and/or in parallel, wherein a "heat exchanger section" is a part of the heat exchanger in which indirect heat exchange is taking place between two or more streams. Each such section may constitute a separate unit having its own housing, but equally sections may be combined into a single heat exchanger unit sharing a common housing. Unless otherwise indicated, the heat exchanger unit(s) may be of any suitable type, such as but not limited to the shell and tube, coil wound, or plate and fin types of heat exchanger unit.

As used herein, the terms "warm" and "cold" are relative terms and are not intended to imply any particular temperature ranges, unless otherwise indicated.

As used herein, the "warm end" and "cold end" of a heat exchanger or heat exchanger section refer to the ends of the heat exchanger or heat exchanger section that are of the highest and lowest temperature (respectively) for that heat exchanger or heat exchanger section. An "intermediate location" of a heat exchanger refers to a location between the warm and cold ends, typically between two heat exchanger sections that are in series.

As used herein, the term "warm side" of a heat exchanger or heat exchanger section refers to the side through which the stream or streams of fluid pass that are to be cooled by indirect heat exchange with the fluid flowing through the cold side. The warm side may define a single passage through the heat exchanger or heat exchanger section for receiving a single stream of fluid, or more than one passage through the heat exchanger or heat exchanger section for receiving multiple streams of the same or different fluids that are kept separate from each other as they pass through the heat exchanger or heat exchanger section. Similarly, the term "cold side" of a heat exchanger or heat exchanger section refers to the side through which the stream or streams of fluid pass that are to be warmed by indirect heat exchange with the fluid flowing through the warm side. The cold side may likewise define a single passage through the heat exchanger or heat exchanger section for receiving a single stream of fluid, or more than one passage through the heat exchanger or heat exchanger section for receiving multiple streams of fluid that are kept separate from each other as they pass through the heat exchanger or heat exchanger section.

As used herein, the terms "cold heat exchanger section" and "warm heat exchanger section", when used in relation to the same heat exchanger, refer to two heat exchanger sections that are arranged in series, wherein the cold heat exchanger section is the section nearer to the cold end of the heat exchanger and the warm heat exchanger section is the section nearer to the warm end of the heat exchanger section.

As used herein, the term "main heat exchanger" refers to the heat exchanger responsible for cooling and liquefying the natural gas feed stream to produce the first LNG stream.

As used herein, the term "vapor" or "vaporized" refers to a fluid that is in the gaseous phase, or in relation to a supercritical fluid to a fluid that is has a density that is less that the critical point density for that fluid. As used herein the term "liquid" or "liquefied" refers to a fluid that is in the liquid phase, or in relation to a supercritical fluid to a fluid that has a density that is greater than the critical point density for that fluid. As used herein, the term "two-phase" or "partially vaporized" refers to a subcritical fluid (particularly a stream thereof) that comprises both gaseous and liquid phases.

As used herein, the term "liquefying" refers to the conversion (typically by cooling) of a fluid or stream of fluid from a vapor to a liquid. As used herein, the term "subcooling" refers to the further cooling of an already fully liquefied fluid or stream of fluid. As used herein, the term "vaporizing" refers to the conversion (typically by warming) of a fluid or stream of fluid from a liquid to a vapor. As used herein, the term "partially vaporizing" refers, in connection to a stream of fluid, to the conversion of some of the fluid in the stream from a liquid to a vapor thereby resulting in a two-phase stream.

As used herein, the term "coil wound heat exchanger" refers to a heat exchanger of the type known in the art, comprising one or more tube bundles encased in a housing known as a "shell", wherein each tube bundle may have its own shell, or wherein two or more tube bundles may share a common shell casing. Each tube bundle may represent a heat exchanger section, the tube side of the bundle (the interior of the tubes in the bundle) typically representing the warm side of said section and defining one or more passages through the section, and the shell side of the bundle (the space between and defined by the interior of the shell and exterior of the tubes) typically representing the cold side of said section defining a single passage through the section. Coil wound heat exchangers are a compact design of heat exchanger known for their robustness, safety, and heat transfer efficiency, and thus have the benefit of providing highly efficient levels of heat exchange relative to their footprint. However, because the shell side defines only a single passage through the heat exchanger section, it is not possible use more than one stream of refrigerant in the shell side of each coil wound heat exchanger section without said streams of refrigerant mixing in the shell side (i.e. typically the cold side) of said heat exchanger section.

As used herein, the term "distillation column" refers to a column (or set of columns) containing one or more separation sections, each separation section being composed of one or more separation stages (that for example comprise inserts such as packing and/or trays) that increase contact and thus enhance mass transfer between the upward rising vapor and downward flowing liquid flowing through the section inside the column. In this way, the concentration of lighter components (such as nitrogen) is increased in the overhead vapor, and the concentration of heavier components (such as methane) is increased in the bottoms liquid. The term "overhead vapor" refers to the vapor that collects at the top of the column. The term "bottoms liquid" refers to the liquid that collects at the bottom of the column. The "top" of the column refers to the part of the column above the separation sections. The "bottom" of the column refers to the part of the column below the separation sections. An "intermediate location" of the column refers to a location between the top and bottom of the column, typically between two separation sections that are in series. The term "reflux" refers to a source of downward flowing liquid from the top of the column. The term "boilup" refers to a source of upward rising vapor from the bottom of the column.

As used herein, the term "overhead heat exchanger" refers to a heat exchanger that recovers cold from the distillation column overhead vapor, and the term "reboiler heat exchanger" refers to a heat exchanger that warms and vaporizes a portion of the distillation column bottoms liquid to provide boilup to the distillation column As used herein, the term "refrigeration circuit" refers to the collection of components necessary for supplying a cooled refrigerant to the cold side of a heat exchanger or heat exchanger section and withdrawing a warmed refrigerant from the cold side of a heat exchanger or heat exchanger section in order to provide cooling duty to said heat exchanger or heat exchanger section. It may also comprise those components necessary for recycling at least a portion of said warmed refrigerant by compressing, cooling and expanding said warmed refrigerant so as to regenerate cooled refrigerant for resupply to the heat exchanger. Accordingly, the refrigerant circuit may typically comprise one or more compressors, aftercoolers, expansion devices, and associated conduits.

As used herein, the term "expansion device" refers to any device or collection of devices suitable for expanding and thereby lowering the pressure of a fluid. Suitable types of expansion device for expanding a fluid include, but are not limited to: turbines, in which the fluid is work-expanded, thereby lowering the pressure and temperature of the fluid; and Joule-Thomson valves (also known as J-T valves), in which the fluid is throttled, thereby lowering the pressure and temperature of the fluid via Joule-Thomson expansion.

As used herein, the term "fluid flow communication" indicates that the devices or components in question are connected to each other in such a way that the stream(s) that are referred to can be sent and received by the devices or components in question. The devices or components may, for example be connected by suitable tubes, passages or other forms of conduit for transferring the stream(s) in question, and they may also be coupled together via other components of the system that may separate them, such as for example via one or more valves, gates, or other devices that may selectively restrict or direct fluid flow.

Solely by way of example, a comparative arrangement and various exemplary embodiments of the invention will now be described with reference to FIGS. 1 to 4. In these Figures, where a feature is common to that of the preceding figure, that feature has been assigned the same reference numeral increased by an increment of 100. For example, if a feature in FIG. 1 has the reference numeral 110, that same feature in FIG. 2 would have the reference numeral 210, and in FIG. 3 would have the reference numeral 310.

Referring now to FIG. 1, a natural gas liquefaction method and system according to a comparative arrangement, not in accordance with the present invention, is shown. FIG. 1 depicts the method and system for liquefying and removing nitrogen from a natural gas stream that is similar to that disclosed in FIG. 1 of U.S. Pat. No. 9,945,604.

Nitrogen containing natural gas feed stream 100 is passed through and is cooled and liquefied in the warm side of main heat exchanger 102, thereby producing a first LNG stream 104, the natural gas feed stream being cooled and liquefied via indirect heat exchange with a mixed refrigerant flowing through and being warmed and vaporized in the cold side of the main heat exchanger 102. In the arrangement shown in FIG. 1, main heat exchanger 102 is a coil-wound heat exchanger, comprising three heat exchanger sections in the form of three tube bundles, namely a warm section/tube bundle 102A, middle section/tube bundle 102B and cold section/tube bundle 102C, all contained within a single shell, the natural gas feed stream flowing through and being cooled and liquefied in the tube side of the main heat exchanger 102 and the first refrigerant flowing through and being warmed in the shell side of the main heat exchanger 102. However, in alternative arrangements the heat exchanger could have more or fewer tube bundles and or the tube bundles could be contained in separate shells interconnected via suitable tubing. Equally, in yet other arrangements other types of heat exchanger could be used, such as for example a different type of shell and tube heat exchanger or a plate and fin heat exchanger, and such heat exchangers could comprise any number of heat exchanger sections.

The mixed refrigerant cycle shown in FIG. 1 that is used to provide refrigeration to the main heat exchanger 102 is a largely conventional single mixed refrigerant (SMR) cycle, and will therefore only briefly be described. Warmed mixed refrigerant 151 exiting the warm end of the main heat exchanger 102 is compressed in compressor 152, cooled in aftercooler 153 and separated in a phase separator 154 into a liquid stream 155 and a vapor stream. The vapor stream is further compressed in compressor 156, cooled in aftercooler 157 and separated in phase separator 158 into a liquid stream 159 and vapor stream 160. All of the aftercoolers typically use an ambient temperature fluid, such as for example air or water, as coolant.

Liquid streams 155 and 159 are passed through and subcooled in the tube side of the warm section 102A of the main heat exchanger 102 before being reduced in pressure through J-T valves and combined to form a cold refrigerant stream 161 that is passed through the shell side of the warm section 102A where it is vaporized and warmed to provide refrigeration to said section. Vapor stream 160 is passed through and cooled and partly liquefied in the tube side of the warm section 102A of the main heat exchanger 102 and is then separated in phase separator 162 into a vapor stream 164 and liquid stream 163. Liquid stream 163 is passed through and subcooled in the tube side of the middle section 102B of the main heat exchanger 102 before being reduced in pressure through a J-T valve to form cold refrigerant stream 165 which is passed through the shell side of the middle and warm sections 102B and 102A where it is vaporized and warmed to provide refrigeration to said sections (mixing in the shell side of warm section 102A with the refrigerant from stream 161). Vapor stream 164 is passed through and liquefied and subcooled in the middle 102B and cold 102C sections of the main heat exchanger 102, exiting the cold end of the main heat exchanger as cold refrigerant stream 166, a major portion of which is expanded through a J-T valve to provide cold refrigerant stream 167 that is passed through the shell side of the cold, middle and warm sections 102C, 102B and 102A where it is vaporized and warmed to provide refrigeration to said sections (mixing in the shell side of the middle section 102B with the refrigerant from stream 165 and further mixing in the shell side of the warm section 102A with the refrigerant from stream 161).

As the mixed refrigerant cycle shown in FIG. 1 is the same as that depicted in and described in relation to FIG. 1 of U.S. Pat. No. 9,945,604, further details regarding the operation said mixed refrigerant cycle can be found in the latter document, the contents of which are incorporated herein in their entirety.

The first LNG stream 104 exits the cold end of the main heat exchanger at a temperature of about −240° F. (−150° C.). The first LNG stream 104 is then further cooled by being passed through the warm side of reboiler heat exchanger 106 and expanded by being passed through J-T valve 108 before being introduced into distillation column 110 at an intermediate location of the column, between two separation sections. Inside the distillation column, the first LNG stream is partially vaporized and is separated into a nitrogen enriched overhead vapor and a nitrogen depleted bottoms liquid. A stream 141 of the bottoms liquid is passed through the cold side of reboiler heat exchanger 106 where it is warmed and at least partially vaporized, via indirect heat exchange with the first LNG stream 104, so as to provide boilup for the distillation column 110. Another stream 132 of the bottoms liquid is withdrawn from the bottom of the distillation column to form a second, nitrogen depleted LNG stream that may be taken directly as the nitrogen depleted LNG product or that may first be stored in an LNG storage tank (not shown).

Reflux for distillation column 110 is provided by recycling and condensing (liquefying) some of the nitrogen enriched overhead vapor. A stream of overhead vapor 112 is warmed to near ambient temperature by being passed through the cold side of overhead heat exchanger 114, and is then divided into two portions. A first portion forms a recycle stream 118, 133, 130 that is used to provide reflux to the distillation column, while a second portion forms a nitrogen vent stream 116 that is vented to atmosphere. The recycle stream 118 is compressed to a high pressure in compressor 120 and cooled in an aftercooler, and the compressed stream 133 is then passed through the warm side of overhead heat exchanger 114 where it is cooled, liquefied and subcooled, via indirect heat exchange with stream 112, before being expanded in J-T valve 143 to form a liquid or two-phase recycle stream 130 that is introduced into the top of the distillation column to provide reflux.

In order to improve the cooling curves in the overhead heat exchanger 114 and thus the efficiency of the process, the mixed refrigerant that is used in the main heat exchanger 102 is also used to provide additional refrigeration to the overhead heat exchanger 114. More specifically, a minor portion (typically less than 20%) of cold refrigerant stream 166 is withdrawn as stream 122 and is reduced in pressure through J-T valve 124 forming a two-phase mixed refrigerant stream 128. This stream 128 is then passed through and is warmed and partially vaporized in the warm side of the overhead heat exchanger 114 so as to provide additional cooling duty for the cooling and liquefaction of recycle stream 133 in overhead heat exchange 114, with the resulting warmed and partially vaporized mixed refrigerant stream 126 being returned to the main heat exchanger via being combined with cold refrigerant stream 165 that is passed through the shell side of the middle and warm sections 102B and 102A.

Although, as noted above, FIG. 1 depicts a method and system for liquefying and removing nitrogen from a natural gas stream that is similar to that shown in U.S. Pat. No. 9,945,604, it should be noted that overhead heat exchanger 114 in FIG. 1 does differ in certain respects to the one shown in U.S. Pat. No. 9,945,604. In particular, the overhead heat exchanger 114 in FIG. 1 comprises three heat exchanger sections, namely cold, middle and warm sections 114A, 114B and 114C, with the mixed refrigerant stream 128 from the main heat exchanger 166 only passing through and being warmed in the middle section 114B of the overhead heat exchanger. The reason for this is that the overhead vapor stream 112 from the distillation column 110 will be significantly colder than mixed refrigerant stream 128. Thus, it is more efficient to use only the overhead vapor stream 112 to provide the cooling duty for subcooling the recycle stream 133 in the cold heat exchanger section 114A.

Figure 2:
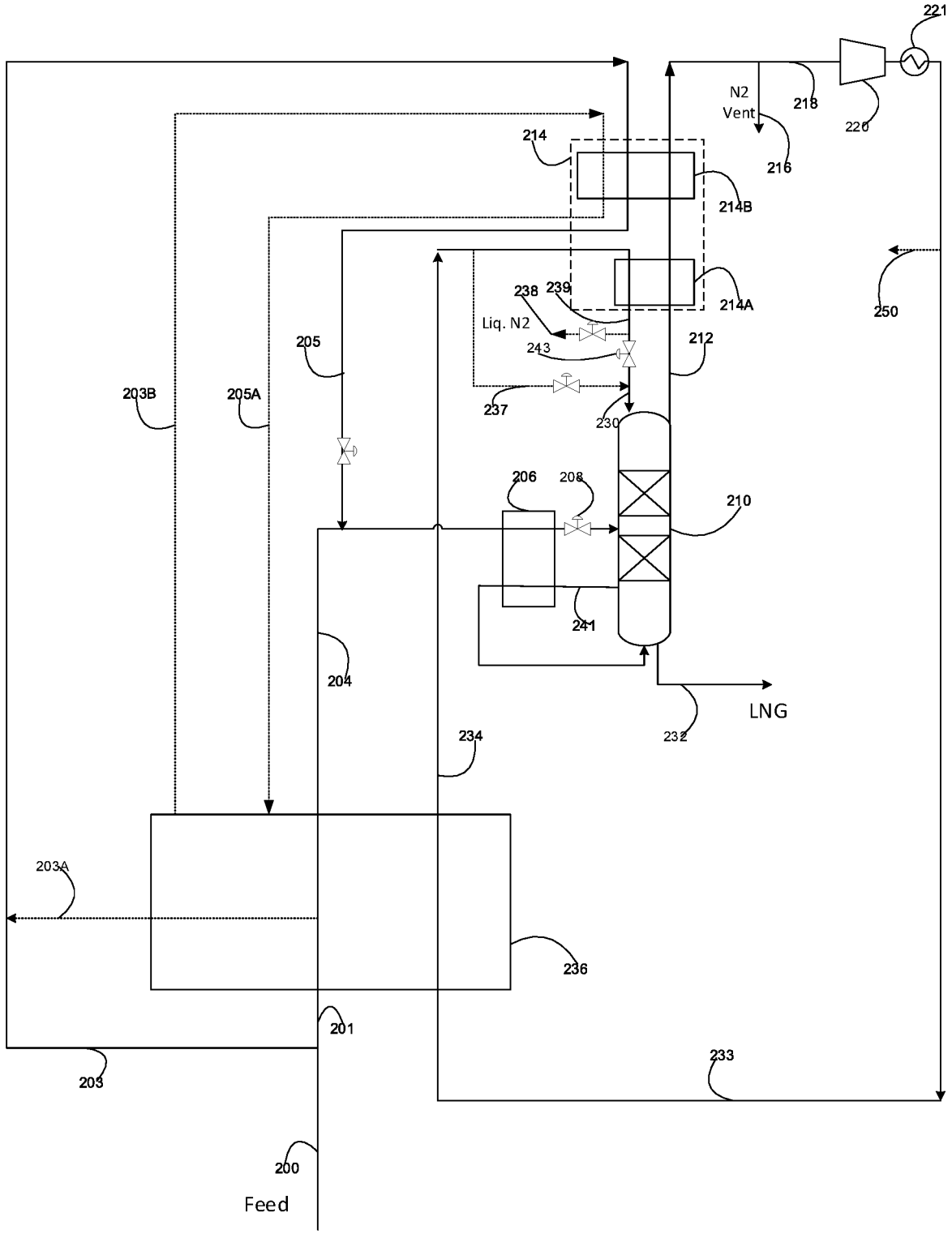
FIG. 2 is a schematic flow diagram depicting a method and system for liquefying and removing nitrogen from a natural gas stream according to one embodiment of the present invention.

Referring now to FIG. 2, a method and system for liquefying and removing nitrogen from a natural gas stream according to one embodiment of the present invention is shown.

Nitrogen containing natural gas feed stream 200, 201 is passed through and is cooled and liquefied in the warm side of main heat exchanger 236, thereby producing a first LNG stream 204, the natural gas feed stream being cooled and liquefied via indirect heat exchange with a first refrigerant (not shown) flowing through the cold side of the main heat exchanger 236. The nitrogen containing natural gas feed stream 200 is typically at ambient temperature, is typically at a high pressure such as at a pressure of about 600 to 1200 psia (40 to 80 bara), and where needed will have been pre-treated (not shown) so as to reduce the levels of any (relatively) high freezing point components, such as moisture, acid gases, mercury and/or heavier hydrocarbons, in the feed stream down to such levels as are necessary to avoid freezing or other operational problems in the main heat exchanger 236. Alternatively or additionally, a heavy component removal step (not shown) could be carried out at an intermediate location of the main heat exchanger, for example to remove LPG components and freezable pentane and heavier components from the feed stream, with the nitrogen containing natural gas feed stream 201 being withdrawn from the intermediate location of the main heat exchanger 236, the heavy component removal step being carried, and the resulting feed stream depleted in heavy components then being returned to an intermediate location of the main heat exchanger 236 to complete the cooling and liquefaction of the feed stream to form the first LNG stream 204.

If desired, prior to introduction of the nitrogen containing natural gas feed stream 200 into the main heat exchanger 236 a minor portion of the nitrogen containing natural gas feed stream 200, usually around 5% of the flow, may be withdrawn as a natural gas stream 203 that bypasses the main heat exchanger. In another alternative, a minor portion, again around 5% of the flow, of the nitrogen containing natural gas feed stream 200, 201 could be withdrawn from an intermediate location of the main heat exchanger as a cooled but not yet liquified or fully liquified natural gas stream (i.e. as a vapor or two-phase stream) 203A, said stream typically being withdrawn at a temperature between ambient temperature and −70° F. (between ambient and −55° C.).

The main heat exchanger 236 and the first refrigerant used in said heat exchanger may be of any type suitable for cooling and liquefying a natural gas stream. For example, the main heat exchanger could be a coil wound heat exchanger comprising one or more heat exchanger sections, and the first refrigerant could be a vaporizing refrigerant such as the mixed refrigerant circulating in the SMR cycle described above with reference to FIG. 1. Equally, however, other type of heat exchanger, and/or other types of refrigerant could be used, many suitable types of heat exchanger and refrigerant being known in the art. For example, the main heat exchanger could alternatively comprise other types of shell and tube heat exchangers and/or a plate and fin heat exchanger, and the refrigerant could be a gaseous refrigerant circulating in a gaseous expansion cycle (such as a reverse Brayton cycle using nitrogen, methane or ethane) or could be a vaporizing refrigerant circulating in a dual mixed refrigerant (DMR) cycle, a propane, ammonia or HFC pre-cooled mixed refrigerant cycle, or a cascade cycle.

The first LNG stream 204 is typically cooled in the main heat exchanger 236 to, and thus typically exits the cold end of the main heat exchanger 236 at, a temperature of from about −220° F. to −250° F. (−140 to −155° C.), and more preferably from about −220° F. to −240° F. (−140 to −150° C.).

The first LNG stream 204 is then further cooled, by being passed through the warm side of a reboiler heat exchanger 206, and expanded, by passing through and being flashed across J-T valve 208, before being introduced into distillation column 210 at an intermediate location of the column, between two separation sections. Inside the distillation column, the first LNG stream is partially vaporized and is separated into a nitrogen enriched overhead vapor and a nitrogen depleted bottoms liquid. A stream 241 of the bottoms liquid is passed through the cold side of reboiler heat exchanger 206 where it is warmed and at least partially vaporized, via indirect heat exchange with the first LNG stream 204, so as to provide boilup for the distillation column 210. Another stream 232 of the bottoms liquid is withdrawn from the bottom of the distillation column to form a second, nitrogen depleted LNG stream that may be taken directly as the nitrogen depleted LNG product or that may first be stored in an LNG storage tank (not shown). Stream 232 typically has a nitrogen content of 1% or less, and preferably 0.5% or less.

Instead of using J-T valve 208 to expand the first LNG stream 204 prior to the introduction of the first LNG stream 204 into the distillation column 210, another form of expansion device, such as for example a liquid turbine, could equally be used.

The reboiler heat exchanger 206 may be a heat exchanger of any suitable type, such as a coil-wound, shell and tube or plate and fin heat exchanger. Although shown in FIG. 2 as being separate from the distillation column, the reboiler heat exchanger may instead be integrated with the bottom of the distillation column.

In yet an alternative arrangement (not shown), the use of a reboiler heat exchanger and the use of a stripping section in the distillation column (the separation section in the distillation column below the point of introduction of the first LNG stream) could both be dispensed with, with the distillation column then containing only a rectification section (the separation section in the distillation column above the point of introduction of the first LNG stream). In such an arrangement the first LNG stream 204 would not be further cooled before being expanded an introduced into the distillation column and would be introduced into distillation column 210 at the bottom of the column, and all of the bottoms liquid would be withdrawn as the second, nitrogen depleted LNG stream 232. However, this would result in a higher concentration of nitrogen in the second, nitrogen depleted LNG stream 232 than that achieved with the arrangement shown in FIG. 2.

The nitrogen enriched overhead vapor that collects at the top of the distillation column 210 is predominantly nitrogen, typically having a methane content of less than 1% and preferably less than 0.1%, and is at its dew point with a temperature of typically about −300 to −320° F. (−185 to −195° C.) and preferably about −310° F. (−190° C.). A stream 212 of the nitrogen enriched overhead vapor is withdrawn from the top of the distillation column 210 and is warmed to near ambient temperature by being passed through the cold side of overhead heat exchanger 214 so as to form a warmed overhead vapor. In the arrangement shown in FIG. 2, the overhead heat exchanger 214 has two heat exchanger sections comprising a cold section 214A and a warm section 214B, the nitrogen enriched overhead vapor stream 212 being introduced into the cold end of the overhead heat exchanger 214, passing through and being warmed in the cold section 214A, passing through and being further warmed in the warm section 214B, and being withdrawn from the warm end of the overhead heat exchanger 214. In the cold section 214A the nitrogen enriched overhead vapor stream 212 is warmed via indirect heat exchange with at least a portion of a recycle stream 234, as will be described below in more detail. In the warm section 214B the low pressure nitrogen gas is warmed via indirect heat exchange with any process stream of a suitable temperature that is desired to be cooled. For example, and as shown in FIG. 2, one or more streams of natural gas stream such as natural gas streams 203 and/or 203A (discussed supra) could be cooled and liquefied by being passed through the warm side of the warm section 214B of the overhead heat exchanger, with the resulting liquefied natural gas stream(s) 205 then being combined with the first LNG stream 204 prior to the introduction thereof into the distillation column 210. Alternatively or additionally, and as also shown in FIG. 2, a stream 203B of first refrigerant could be cooled by being passed through the warm side of the warm section 214B of the overhead heat exchanger to form a cooled stream of first refrigerant 205A that is returned for use in the main heat exchanger 236. For example, where first refrigerant is a mixed refrigerant that being circulated in a SMR cycle as described above with reference to FIG. 1, the stream 203B of first refrigerant that is supplied to the warm section 214B of the overhead heat exchanger may be an ambient temperature mixed refrigerant vapor stream taken from a portion of stream 160 of FIG. 1, and the cooled stream of first refrigerant 205A that is withdrawn from the warm section 214B of the overhead heat exchanger may be expanded and combined with cold refrigerant stream 167 that is introduced into the shell side of the main heat exchanger at the cold end of the main heat exchanger or with cold refrigerant stream 165 that is introduced into the shell side of the main heat exchanger at the cold end of the middle section of the main heat exchanger.

The overhead heat exchanger 214 may be a heat exchanger of any suitable type, such as a coil-wound, shell and tube or plate and fin heat exchanger, but preferably is a heat exchanger of the coil-wound type. Although FIG. 2 depicts both sections of overhead exchanger 214 as being contained within as a single unit, the warm section and cold section could equally be located in separate units each with their own housing. Equally, although shown in FIG. 2 as being separate from the distillation column, the overhead heat exchanger 214 is in a preferred arrangement instead integrated with the top of the distillation column, as will be further described below with reference to the embodiment shown in FIG. 4.

The warmed overhead vapor that is withdrawn from the overhead heat exchanger is divided, with a first portion of the warmed overhead vapor forming a recycle stream 218, 233, 234, 239, 237, 230 that is used to provide reflux to the distillation column by being cooled and liquefied, subcooled, expanded and introduced into the distillation column, and with a second portion of the warmed overhead vapor forming one more nitrogen product or vent streams 250, 238, 216. As will be apparent from the further discussion below, said division of the nitrogen product/vent streams (the second portion of the warmed overhead vapor) from the recycle stream (the first portion of the warmed overhead vapor) can take place at various different locations, subject of course to the proviso that all of said nitrogen product and vent streams are divided and removed from the recycle stream prior to said recycle stream being introduced into the distillation column to provide reflux to the distillation column.

More specifically, a first portion of the warmed overhead vapor forms recycle stream 218 which is compressed to a high pressure, typically greater than 500 psia (greater than 35 bara), in compressor 220 and cooled in aftercooler 221 (typically using ambient cooling water or air). Compressor 220 may comprise multiple stages with ambient intercoolers. The compressed and cooled recycle stream 233 is then passed through the warm side of the main heat exchanger 236 via one or more passages in the warm side of the main heat exchanger that are separate from the passage or passages through which the natural gas feed stream 201 is passed, so as to keep the recycle stream separate from the natural gas feed stream inside the main heat exchanger. As the recycle stream is passed through the warm side of the main heat exchanger 236 it is cooled and liquefied via indirect heat exchange with the first refrigerant, and it exits the cold end of the main heat exchanger as recycle stream 234 at a temperature close to that of the first LNG stream 204, i.e. typically at a temperature of from about −220° F. to −250° F. (−140 to −155° C.), preferably from about −220° F. to −240° F. (−140 to −150° C.), and most preferably from about −230° F. to −240° F. (−145 to −150° C.). At this temperature the recycle stream is fully liquid (or has a liquid like density, i.e. a density that is greater than its critical point density, if the stream is supercritical). Recycle stream 234 is then introduced into the overhead heat exchanger 214 at an intermediate location (between the cold and warm sections) of the heat exchanger and is passed through and is subcooled in the warm side of the cold section 214A of the heat exchanger, via indirect heat exchange with the nitrogen enriched overhead vapor 212 passing through the cold side of said section. The subcooled recycle stream 239 exiting the cold end of the overhead heat exchanger 214 is typically at a temperature of from about −280 to 290° F. (−175 to −180° C.), and is then expanded, for example by being passed through and flashed across a J-T valve 243, to form a liquid or two-phase recycle stream 230 that is introduced into the top distillation column 210 to provide reflux to the column.

Optionally, instead of passing all of recycle stream 234 through the overhead heat exchanger 234 only a first portion of recycle stream 234 is passed through the overhead heat exchanger 234 to form subcooled stream 239, with a second portion of the recycle stream bypassing the overhead heat exchanger as bypass stream 237. Streams 239 and 237 can then be expanded and mixed to form the liquid or two-phase recycle stream 230 that is introduced into the top distillation column 210 (wherein as shown in FIG. 2 streams 239 and 237 can be expanded separately, for example by being passed through separate J-T valves, before being mixed, or wherein streams 239 and 237 could first be mixed and then expanded). Such an arrangement allows subcooled stream 239 to be cooled in the cold section of the 214A of the overhead heat exchanger 214 to a colder temperature than if all the recycle stream is passed through said heat exchanger (since there will be less of the recycle stream flowing through the heat exchanger and needing subcooling), which means that the temperature of stream 239 exiting the cold end of the overhead heat exchanger 214 can more closely match the temperature of the nitrogen enriched overhead vapor 212 entering the cold end of the overhead heat exchanger 214, thus reducing thermal stresses at the cold end of exchanger 214. It can also be beneficial if (as will be further described below) a liquid nitrogen product stream 238 is to be divided from the subcooled stream 239, as this liquid nitrogen product stream 238 will then be available at a colder temperature facilitating storage of said liquid nitrogen product. It does however complicate the process by requiring the use and operation of said bypass stream. It should be noted that this alternative arrangement does not alter the temperature of the liquid or two-phase recycle stream 230 as compared to the arrangement where no bypass is used, as with use of the bypass stream 237 the subcooled stream 239 is available at a colder temperature, but this stream is then warmed somewhat by being mixed with the bypass stream 237 to form the liquid or two-phase recycle stream 230.

As noted above, a second portion of the warmed overhead vapor forms one or more nitrogen product or vent streams 250, 238, 216 that are withdrawn from the natural gas liquefaction system, and these streams can be withdrawn from the system at various different locations. For example, a portion of the overhead vapor can form a nitrogen vent stream 216 that is divided from the portion of the overhead vapor forming the recycle stream 218 prior to the compression of the recycle stream in compressor 220, with said nitrogen vent stream 216 then being vented to the atmosphere. Alternatively or additionally, a portion of the overhead vapor can form a high pressure gaseous nitrogen product stream 250 that is divided from the portion of the overhead vapor forming the recycle stream 233 after said recycle stream has been compressed in compressor 220 and prior to recycle stream being introduced into and cooled and liquefied in the main heat exchanger 236. Alternatively or additionally, a portion of the overhead vapor can form a liquid nitrogen product stream 238 that is divided from the portion of the overhead vapor forming the recycle stream 230 after said recycle stream has been subcooled in the cold section 214A of the overhead heat exchanger 214 and prior to the recycle stream being expanded and introduced into the distillation column 210.

In preferred embodiments, the division of the warmed overhead vapor between the first portion, that forms the recycle stream 218, 233, 234, 239, 237, 230 that provides reflux to the distillation column, and the second portion, that forms the one or more nitrogen product or vent streams 250, 238, 216, is such that the first portion is about 75% of the total flow of warmed overhead vapor exiting the overhead heat exchanger 214 and the second portion is about 25% of the total flow of warmed overhead vapor exiting the overhead heat exchanger 214.

The method and system shown in FIG. 2 provides several benefits over the comparative arrangement shown in FIG. 1.

Like the arrangement shown in FIG. 1, the method and system shown in FIG. 2 allows for the production of a very high purity nitrogen vent stream 216 (and/or a very high purity nitrogen product streams 250, 238), wherein the nitrogen purity is limited only by the flowrate of reflux and number of separation stages in the distillation column, while at the same time producing an LNG product 232 with a very low nitrogen content. Like the arrangement shown in FIG. 1, the method and system shown in FIG. 2 also makes use of the refrigerant used in the main heat exchanger to provide at least some of the cooling duty for liquefying warmed overhead vapor from the distillation column in order to provide reflux to the distillation column, thereby improving the efficiency of the process (as compared to a process in which only cold extracted from the overhead vapor itself is used to provide such cooling duty).

However, whereas the arrangement shown in FIG. 1 requires the transfer of two-phase mixed refrigerant streams 128 and 126 to and from the overhead heat exchanger, which complicates the design of the piping and may cause undesirable unsteady operation due to slugging, in the arrangement shown in FIG. 2 no two-phase refrigerant streams are transferred or required to be transferred to the overhead heat exchanger in order to provide cooling duty to said heat exchanger.

Equally, the arrangement shown in FIG. 1 requires the use of a two-phase refrigerant in the cold side of the overhead heat exchanger, which may require special design features to ensure the liquid and vapor phases are evenly distributed. For example, if the overhead heat exchanger is a plate-fin exchanger, special devices such as a separator and injection tubes must be provided to evenly distribute the phases across all passages. The use of these devices adds cost. Additionally, the two-phase flow may become unstable at low flowrates causing disengagement of the phases resulting in large internal temperature gradients and potential damage to the exchanger. In the arrangement shown in FIG. 2 no two-phase refrigerant is used in the cold side of the overhead heat exchanger, so that such problems are avoided.

The arrangement shown in FIG. 1 also requires the use of an overhead heat exchanger having three heat exchanger sections, whereas in the method and system of FIG. 2 only two heat exchanger sections are required, reducing the cost and complexity of the overhead heat exchanger.

Another disadvantage of the arrangement shown in FIG. 1 is that it requires that both an overhead vapor stream 112 and mixed refrigerant stream 128 are passed through the cold side of the overhead heat exchanger 114 while being kept separate from each other, which in turn requires the use of a heat exchanger that has a cold side consisting of two or more separate passages. This practically precludes the use in FIG. 1 of a coil-wound heat exchanger as the overhead heat exchanger. To use a coil-wound heat exchanger as the overhead heat exchanger 114 in FIG. 1 would require the coil-wound heat exchanger to be used in the opposite manner to normal, with the shell side being used as the warm side of the heat exchanger and receiving the higher pressure recycle stream that is to be cooled, liquefied and subcooled to provide reflux to the distillation column, and with the tube side (which comprises multiple passages) receiving the lower pressure overhead vapor stream 112 and mixed refrigerant stream 128. Such a design would be difficult given the low available pressure drop of the cold streams 112 and 128 and the relatively high resistance typical of the passages in the tube bundle. Conversely, the method and system of FIG. 2 allows a coil-would heat exchanger to be used as the overhead heat exchanger 214, since the nitrogen enriched overhead vapor stream 212 is providing all of the cooling duty to the overhead heat exchanger 214 and can be passed on its own through the low resistance shell side. This is advantageous, as coil-wound heat exchangers have been proven to be efficient, reliable and robust for natural gas liquefaction end flash gas heat exchange applications.

Figure 3:
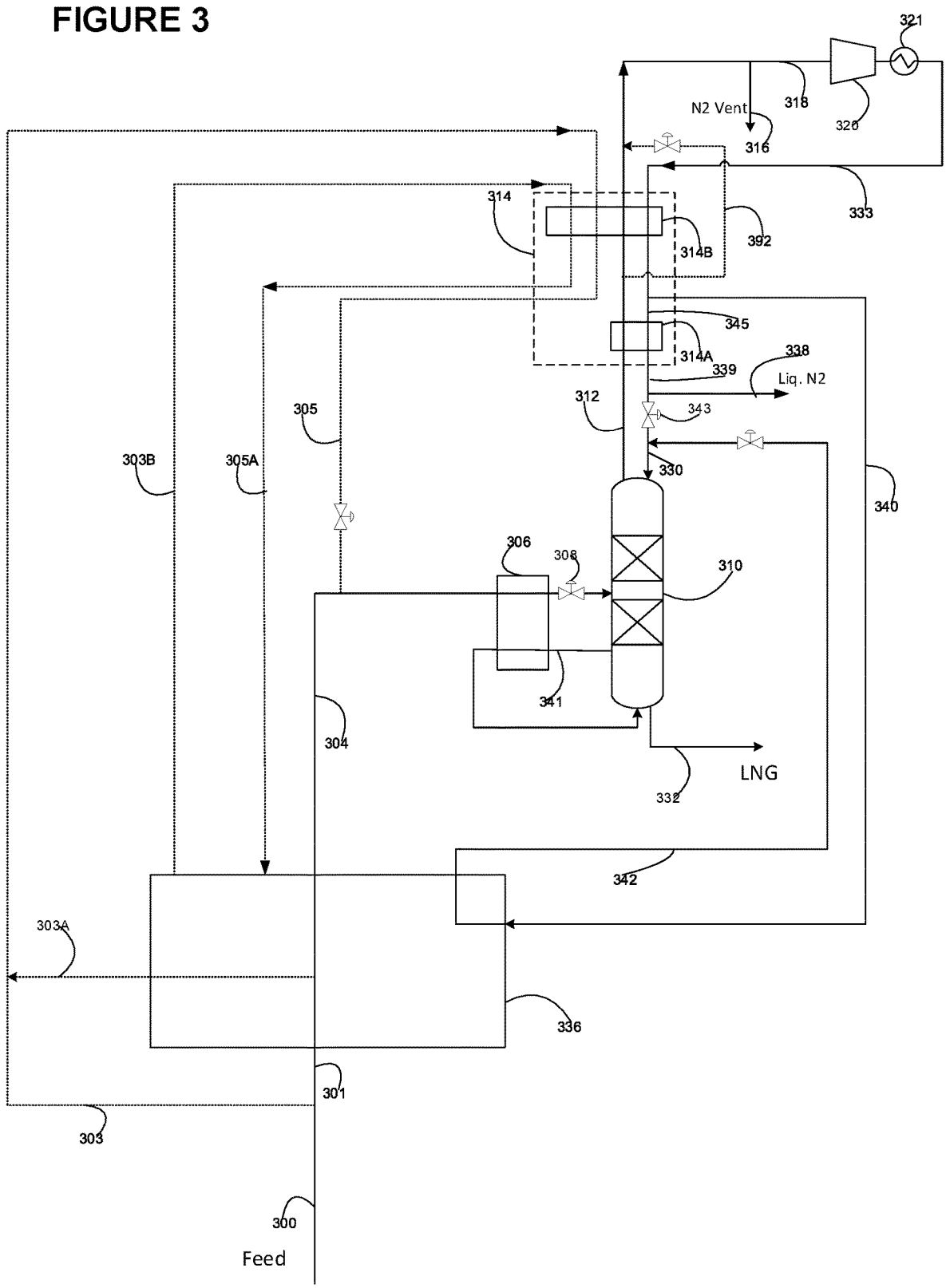
FIG. 3 is a schematic flow diagram depicting a method and system for liquefying and removing nitrogen from a natural gas stream according to another embodiment of the present invention.

Referring now to FIG. 3, a method and system for liquefying and removing nitrogen from a natural gas stream according to an alternative embodiment of the present invention is shown. The method and system of FIG. 3 differs from the arrangement shown in FIG. 2 primarily only as regards the way in which the recycle stream is cooled, liquefied and subcooled, and only the differences from FIG. 3 will be described below.

More specifically, the compressed and cooled recycle stream 333 from aftercooler 321 is in this case passed through and cooled in the warm side of the warm heat exchanger section 314B of the overhead heat exchanger 314. The cooled recycle stream exiting the warm section is typically at a temperature where it is still all or mostly vapor (or has a vapor like density, i.e. a density that is less than its critical point density, if the stream is supercritical), and typically exits the cold end of the warm heat exchanger section 314B at a temperature of about −180° F. (−115° C.). The cooled recycle stream exiting the warm section is then divided into a first portion, stream 340, and a second portion, stream 345. Typically, the division of the cooled recycle stream may be such that about 50% of the stream forms stream 340 and about 50% of the stream forms stream 345.

The first portion, stream 340, is then passed through the warm side of the main heat exchanger 336 where it is cooled and liquefied via indirect heat exchange with the first refrigerant to form a first liquefied portion, stream 342. More specifically, stream 340 is passed through the warm side of the main heat exchanger via one or more passages in the warm side of the main heat exchanger that are separate from the passage or passages through which the natural gas feed stream 301. Stream 340 may in particular be introduced into an intermediate location of the main heat exchanger 336. For example, where the main heat exchanger 336 is a coil wound heat exchanger such as that shown in FIG. 1, stream 340 may be introduced at an intermediate location between the middle 102B and cold 102C bundles and passed through the tube side of the cold bundle 102C so as to be cooled and liquefied. It exits the cold end of the main heat exchanger as liquified stream 342 at a temperature close to that of the first LNG stream 304, i.e. typically at a temperature of from about −220° F. to −250° F. (−140 to −155° C.), preferably from about −220° F. to −240° F. (−140 to −150° C.), and most preferably from about −230° F. to −240° F. (−145 to −150° C.), and is fully liquid (or has a liquid like density, i.e. a density that is greater than its critical point density, if the stream is supercritical).

The second portion, stream 345, is introduced into and passed through the warm side of the cold section 314A of the overhead heat exchanger 314 where it is liquefied and subcooled via indirect heat exchange with the nitrogen enriched overhead vapor 312 passing through the cold side of said section to form a second liquefied and subcooled portion, stream 339. Stream 339 exits the cold end of the overhead heat exchanger 314 typically at a temperature close to that of the temperature of the nitrogen enriched overhead vapor 312 entering the cold end of the overhead heat exchanger 314

Stream 339 and 342 are then expanded and mixed to form the liquid or two-phase recycle stream 330 that is introduced into the top distillation column 310 to provide reflux to the distillation column (wherein as shown in FIG. 3 streams 339 and 342 can be expanded separately, for example by being passed through separate J-T valves, before being mixed, or wherein streams 339 and 342 can first be mixed and then expanded).

Optionally, one or more additional process streams can be passed through and warmed in the warm side of the warm section 314B of the overhead heat exchanger 314 in addition to (and separately from) the compressed and cooled recycle stream 333. For example, and as discussed in relation to FIG. 2, one or more streams of natural gas such as natural gas streams 303 and/or 303A, and/or one or more streams of first refrigerant 303B could additionally be cooled in the warm section 314B. However, as compared to the arrangement shown in FIG. 2, in the method and system shown in FIG. 3 the flow rate of said additional process streams would be much lower, as in FIG. 3 the hot stream duty in the warm section 314B is provided primarily by the recycle stream 333, the additional process streams being used to balance the heat load of warm section 314B. Thus, for example, where a natural gas stream 303 is passed through the warm section 314B, in the arrangement shown in FIG. 3 the flow rate of stream 303 would typically be less than 1% of the total flow rate of natural gas feed stream 300.

One potential advantage that the FIG. 3 arrangement has over the FIG. 2 arrangement is that potential contamination of the nitrogen enriched overhead vapor stream 312 inside the overhead heat exchanger is easier to avoid and mitigate. The flow of any additional process streams 303, 303A, 303B through the overhead heat exchanger may be stopped if a leak in the warm section 314B is detected. In this case, and if needed, balancing of the heat load of the warm section 314B, so as to minimize warm end temperature differences and resulting thermal stresses, may be accomplished by withdrawing a portion 392 of the nitrogen enriched overhead vapor from the cold side of the overhead heat exchanger 314 between the cold section 314A and the warm section 314B via a bypass line so that said portion 392 bypasses and is not further warmed in the warm section 314B of the overhead heat exchanger 314.

Figure 4:
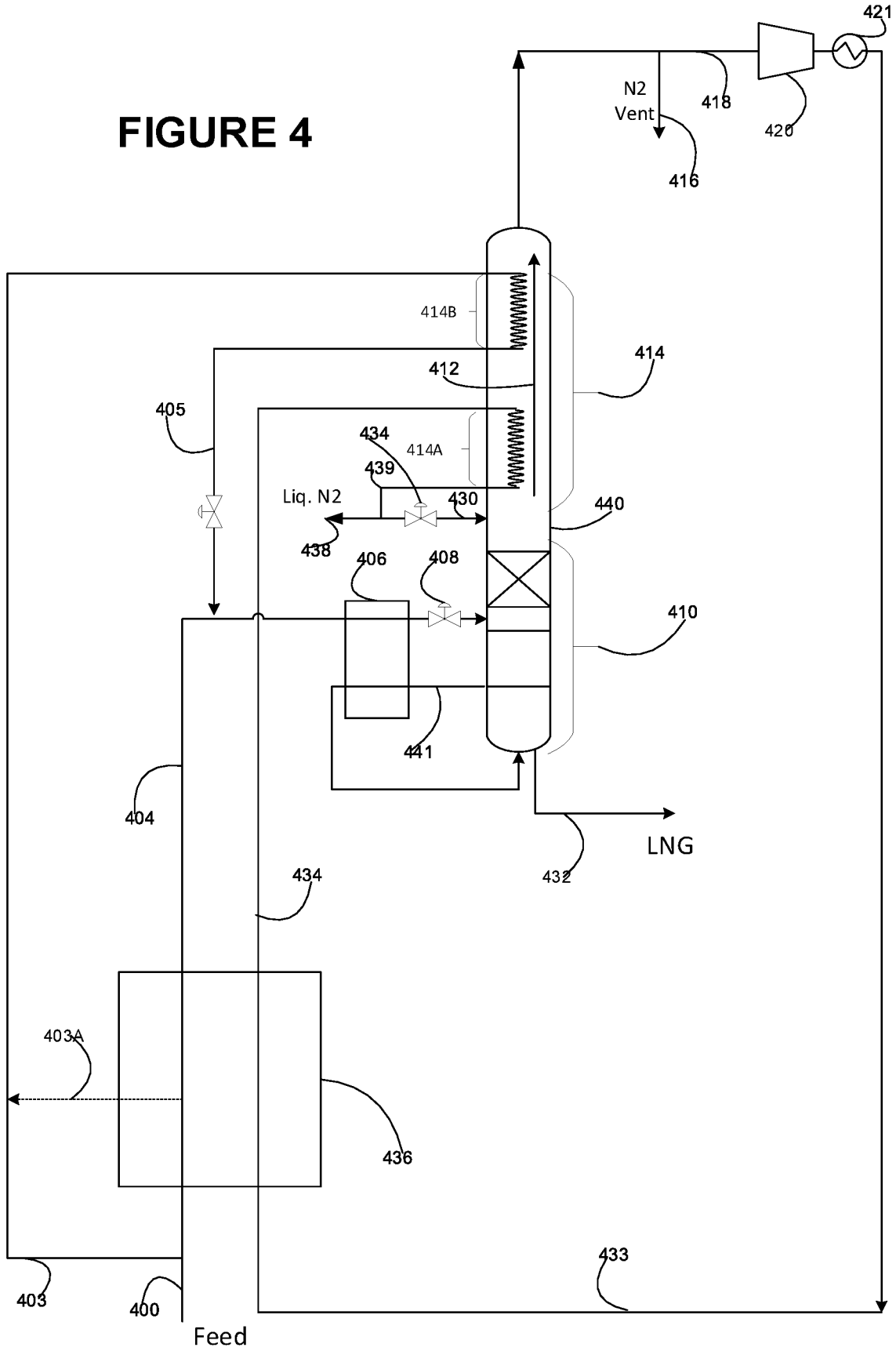
FIG. 4 is a schematic flow diagram depicting a method and system for liquefying and removing nitrogen from a natural gas stream according to another embodiment of the present invention.

Referring now to FIG. 4, a method and system for liquefying and removing nitrogen from a natural gas stream according to another embodiment of the present invention is shown. The arrangement shown in FIG. 4 represents a preferred variant of the embodiment shown in FIG. 2, wherein the overhead heat exchanger 414 is integrated with the top of the distillation column. This variation is equally applicable to the embodiment shown in FIG. 3.

More specifically, in the arrangement shown in FIG. 4 the overhead heat exchanger 414 is a coil wound heat exchanger that is integrated with the top 440 of the distillation column 410, the cold and warm sections of the overhead heat exchanger comprising, respectively, cold tube bundle 414A and warm tube bundle 414B, the cold tube bundle 414A and warm tube bundle 414B being located within the top 440 of the distillation column, and the shell of the overhead heat exchanger forming the top part of the distillation column shell.

A stream 412 of the nitrogen enriched overhead vapor that collects at the top 440 of the distillation column 410, below the cold end of the overhead heat exchanger 414, then passes through the shell side of the overhead heat exchanger 414 (that also forms the top part of the distillation column shell) and is warmed to near ambient temperature via indirect heat exchange with the streams passing through the tube sides of the cold 414A and warm 414B tube bundles, exiting the warm end of the overhead heat exchanger 414 (and top of the distillation column 410) as the warmed overhead vapor that is divided, as discussed supra, into first and second portions: the first portion forming a recycle stream 418, 433, 434, 439, 430 that is used to provide reflux to the distillation column by being cooled and liquefied, subcooled, expanded and introduced into the top 440 of the distillation column 410 (below the cold end of the overhead heat exchanger 414); and the second portion forming one more nitrogen product streams 438 or vent streams 416.

An advantage of the arrangement shown in FIG. 4 is that the interconnecting piping and nozzles required in the FIG. 2 arrangement between column 210 and exchanger 214 to transmit the nitrogen enriched overhead vapor stream 212 are eliminated, along with the associated pressure drop. Nitrogen enriched overhead vapor stream 212 is low pressure, and thus requires in the FIG. 2 arrangement a very large bore cryogenic pipe. In the FIG. 4 arrangement, nitrogen enriched overhead vapor stream 412 flows through the distillation column 410/overhead heat exchanger 414 shell using the full diameter of the shell. Any low pressure piping between the cold and warm heat exchanger sections of the overhead heat exchanger is likewise also eliminated, with the nitrogen enriched overhead vapor flowing up in the shell between the tube bundles 414A and 414B. This arrangement shown in FIG. 4 also minimizes the plot space of the system and again makes use of robust coil wound exchangers, minimizing the potential for damage due to thermal stresses resulting from transient operation.

Figure 5:
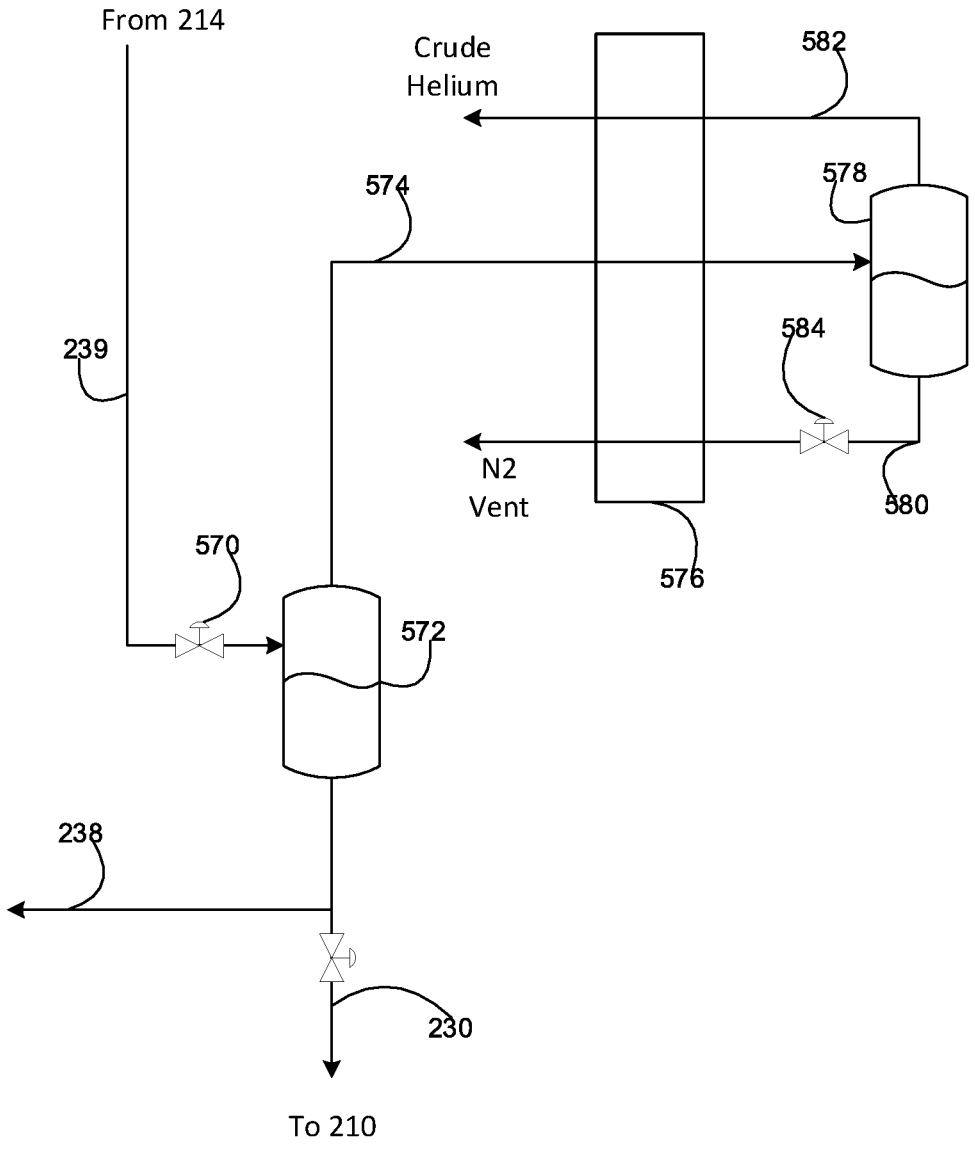
FIG. 5 is a schematic flow diagram depicting a modification to the method and system depicted in FIG. 2 allowing additional separation and recovery of a crude helium stream.

Referring now to FIG. 5, an optional modification to the method and system of FIG. 2 is shown that allows for additional separation and recovery of a crude helium stream, this modification being equally applicable to the embodiments shown in FIGS. 3 and 4.

More specifically, in the modification shown in FIG. 5, subcooled recycle stream 239 exiting the cold end of the overhead heat exchanger 214 contains a small amount of helium and, instead of being expanded and introduced directly into the top of the distillation column 210, it is expanded, for example by being flashed through a J-T valve 570, to an intermediate pressure of about 20 to 120 psia (1.4 to 8.3 bara), forming a small amount of vapor in the stream which contains around 90-95% of the trace helium contained in the stream. The resulting stream is separated in drum 572, with the helium containing vapor 574 being cooled and partly condensed in heat exchanger 576 to a temperature of about −315° F. (−190° C.), then separated using drum 578 into a liquid nitrogen stream 580, and a crude helium stream 582. Stream 582 has a helium content of around 80%. The liquid nitrogen stream 580 is expanded, for example by being flashed across J-T valve 584, to a pressure of 1-10 psig (0.07-0.7 barg) and then vaporized in heat exchanger 576, providing the refrigeration to cool stream 574, before being vented. The crude helium stream 582 is warmed in heat exchanger 576 providing refrigeration, before being stored as product or sent to a helium refining unit for further purification. The liquid from drum 572 is withdrawn and expanded to form the liquid or two-phase recycle stream 230 that is introduced into the top of distillation column 210 to provide reflux to the column.

EXAMPLE

Table 1 shows stream data from a simulated example of the invention according to the embodiment of FIG. 2. In this simulated example, compressor 220 is four stages with a total power consumption of 3756 hp.

TABLE 1

| | 200 | 203 | 201 | 204 | 205 | 232 | 212 | 216 | 218 | 233 | 234 | 239 |
|---|---|---|---|---|---|---|---|---|---|---|---|---|
| Temperature ° F. | 100 | 100 | 100 | −234 | −234 | −253 | −314 | 48 | 48 | 117 | −234 | −280 |
| Pressure, PSIA | 1100 | 1100 | 1100 | 271 | 1095 | 25 | 22 | 18 | 18 | 718 | 588 | 580 |
| Vapor Fraction | 1 | 1 | 1 | 0 | 0 | 0 | 1 | 1 | 1 | 1 | 0 | 0 |
| Flow, lb-moles/hr | 12186 | 716 | 11471 | 11471 | 716 | 11513 | 2005 | 497 | 1508 | 1372 | 1372 | 1372 |
| Mole Fractions: | | | | | | | | | | | | |
| Nitrogen | 0.07 | 0.07 | 0.07 | 0.07 | 0.07 | 0.01 | 1.00 | 1.00 | 1.00 | 1.00 | 1.00 | 1.00 |
| Methane | 0.93 | 0.93 | 0.93 | 0.93 | 0.93 | 0.99 | 0.00 | 0.00 | 0.00 | 0.00 | 0.00 | 0.00 |

It will be appreciated that the invention is not restricted to the details described above with reference to the preferred embodiments, but that numerous modifications and variations can be made without departing from the spirit or scope of the invention as defined in the following claims.

The invention claimed is:

1. A method for liquefying a natural gas feed stream and removing nitrogen therefrom, the method comprising:

(a) passing a nitrogen containing natural gas feed stream through a main heat exchanger and cooling and liquefying the natural gas stream in the main heat exchanger via indirect heat exchange with a first refrigerant, thereby producing a first LNG stream;

(b) withdrawing the first LNG stream from the main heat exchanger;

(c) expanding the first LNG stream and introducing said stream into a distillation column in which the stream partially vaporizes and is separated into a nitrogen enriched overhead vapor and a nitrogen depleted bottoms liquid;

(d) withdrawing a stream of the nitrogen depleted bottoms liquid from the distillation column to form a second, nitrogen depleted, LNG stream;

(e) warming a stream of the nitrogen enriched overhead vapor in an overhead heat exchanger to form a warmed overhead vapor;

(f) compressing, cooling and liquefying, subcooling and expanding a recycle stream formed from a first portion of the warmed overhead vapor to form a liquid or two-phase recycle stream and introducing said liquid or two-phase recycle stream into the distillation column to provide reflux to the distillation column;

(g) forming one or more nitrogen product streams or vent streams from a second portion of the warmed overhead vapor;

wherein in step (f) at least a portion of the recycle stream is liquefied via indirect heat exchange with the first refrigerant by passing said at least a portion of the recycle stream through the main heat exchanger, separately from the natural gas feed stream;

wherein in step (f) the recycle stream is subcooled via indirect heat exchange with the nitrogen enriched overhead vapor by passing a least a portion of the recycle stream through the overhead heat exchanger; and wherein the overhead heat exchanger is separate from the main heat exchanger, and all of the cooling duty for the overhead heat exchanger is provided by the warming of the stream of the nitrogen enriched overhead vapor in step (e).

2. The method of claim 1, wherein the overhead heat exchanger is a coil wound heat exchanger comprising one or more tube bundles contained within a shell and defining a tube side and a shell of the heat exchanger, wherein in step (e) the stream of the nitrogen enriched overhead vapor passes through and is warmed in the shell side of the overhead heat exchanger, and wherein in step (f) the recycle stream is subcooled by passing a least a portion of the recycle stream through the tube side of the overhead heat exchanger.

3. The method of claim 2, wherein the overhead heat exchanger is integrated with the distillation column, with the one or more tube bundles being located within the top of the distillation column and with the shell of the overhead heat exchanger forming the top part of the distillation column shell.

4. The method of claim 1, wherein the overhead heat exchanger comprises a warm heat exchanger section and a cold heat exchanger section, and wherein in step (f) the recycle stream is subcooled by passing a least a portion of the recycle stream through the cold heat exchanger section.

5. The method of claim 4, wherein in step (f) a portion or all of the recycle stream is cooled by passing said portion or all of the recycle stream through the warm heat exchanger section.

6. The method of claim 4, wherein one or more streams of natural gas or first refrigerant are cooled by passing said stream(s) through the warm heat exchanger section.

7. The method of claim 1, wherein in step (f) all of the recycle stream is liquefied via indirect heat exchange with the first refrigerant by passing said stream through the main heat exchanger to form a liquefied recycle stream.

8. The method of claim 7, wherein in step (f) the recycle stream is subcooled by passing all of the liquefied recycle stream through the overhead heat exchanger.

9. The method of claim 7, wherein in step (f) the recycle stream is subcooled by passing a first portion of the liquefied recycle stream through the overhead heat exchanger to form a subcooled portion, wherein a second portion of the liquefied recycle stream bypasses the overhead heat exchanger and is then mixed with the subcooled portion, and wherein the subcooled portion and second portion are expanded prior to or after being mixed, so as to form the liquid or two-phase recycle stream that provides reflux to the distillation column.

10. The method of claim 1, wherein in step (f) a first portion of the recycle stream is liquefied via indirect heat exchange with the first refrigerant by passing said first portion of the recycle stream through the main heat exchanger to form a first liquefied portion, and a second portion of the recycle stream is liquefied and subcooled by being passed through the overhead heat exchanger to form a second liquefied and subcooled portion, wherein the first liquefied portion and second liquefied and subcooled portion are then mixed, and wherein the first liquefied portion and second liquefied and subcooled portion are expanded prior to or after being mixed, so as to form the liquid or two-phase recycle stream that provides reflux to the distillation column.

11. The method of claim 1, wherein the first LNG stream is introduced in step (c) into the distillation column at an intermediate location of the distillation column.

12. The method of claim 11, wherein step (c) further comprises cooling the first LNG stream in a reboiler heat exchanger prior to introducing the first LNG stream into the distillation column; and wherein the method further comprises warming and vaporizing a portion of the nitrogen depleted bottoms liquid in the reboiler heat exchanger, via indirect heat exchange with the first LNG stream, so as to provide boilup to the distillation column.

13. The method of claim 1, wherein in step (b) the first LNG stream is withdrawn from the cold end of the main heat exchanger, and wherein in step (f) the at least a portion of the recycle stream that is liquefied in the main heat exchanger is withdrawn from the cold end of the main heat exchanger.

14. The method of claim 1, wherein in step (b) the first LNG stream is withdrawn from the main heat exchanger at a temperature of about −220 to −250° F. (about −140 to −155° C.).

15. The method of claim 1, wherein in step (f) the at least a portion of the recycle stream that is liquefied in the main heat exchanger is withdrawn from the main heat exchanger at a temperature of about −220 to −250° F. (about −140 to −155° C.).

16. The method of claim 1, wherein the nitrogen enriched overhead vapor enters the cold end of the overhead heat exchanger at a temperature of about −300 to −320° F. (−185 to −195° C.).

17. The method of claim 1, wherein the first refrigerant is a refrigerant that is vaporized as it is passed through the main heat exchanger to provide the cooling duty for liquefying the natural gas stream in the main heat exchanger in step (a) and for liquefying the at least a portion of the recycle stream in the main heat exchanger in step (f).

18. The method of claim 17, wherein in step (f) the recycle stream is compressed to a pressure such that the at least a portion of the recycle stream that is liquefied inside the main heat exchanger finishes liquefying at a temperature that is from 0 to 10° F. (0 to 5° C.) higher than the temperature at which the first refrigerant starts to vaporize inside the main heat exchanger.

19. A system for liquefying a natural gas feed stream and removing nitrogen therefrom, the system comprising:

a main heat exchanger having a warm side comprising one or more passages for receiving a nitrogen containing natural gas feed stream and a cold side comprising one or more passages for receiving a stream of a first refrigerant, the warm and cold sides being configured such that when the nitrogen containing natural gas feed stream is passed through the warm side it is cooled and liquefied by indirect heat exchange with the stream of the first refrigerant passing through the cold side, thereby producing a first LNG stream;

a first refrigerant circuit, for supplying a cooled stream of the first refrigerant to the cold side of the main heat exchanger and withdrawing a warmed stream of the first refrigerant stream from the cold side of the main heat exchanger;

an expansion device in fluid flow communication with the main heat exchanger for receiving and expanding the first LNG stream;

a distillation column in fluid flow communication with the expansion device for receiving the first LNG stream from the expansion device, the first LNG stream being partially vaporized and separated inside the distillation column into a nitrogen enriched overhead vapor and a nitrogen depleted bottoms liquid;

a conduit for withdrawing a stream of the nitrogen depleted bottoms liquid from the distillation column to form a second, nitrogen depleted, LNG stream;

an overhead heat exchanger having cold side comprising one or more passages for receiving a stream of the nitrogen enriched overhead vapor and a warm side comprising one or more passages, the warm and cold sides being configured such that nitrogen enriched overhead vapor passing through the cold side is warmed by indirect heat exchange with fluid passing through the warm side, thereby producing a warmed overhead vapor;

a reflux circuit for compressing, cooling and liquefying, subcooling and expanding a recycle stream formed from a first portion of the warmed overhead vapor to form a liquid or two-phase recycle stream and for introducing said liquid or two-phase recycle stream into the distillation column to provide reflux to the distillation column;

one or more conduits for withdrawing from the system one or more nitrogen product streams or vent streams formed from a second portion of the warmed overhead vapor;

wherein the reflux circuit is configured to liquefy said at least a portion of the recycle stream via indirect heat exchange with the first refrigerant by passing said at least a portion of the recycle stream through one or more passages in the warm side of the main heat exchanger, separately from the natural gas feed stream;

wherein the reflux circuit is configured to subcool the recycle stream via indirect heat exchange with the nitrogen enriched overhead vapor by passing at least a portion of the recycle stream through one or more of said passages in the warm side of the overhead heat exchanger; and wherein the overhead heat exchanger is separate from the main heat exchanger, and the system is configured such that the stream of nitrogen enriched overhead vapor is the only stream that passes through the cold side of the overhead heat exchanger and so provides all of the cooling duty for the overhead heat exchanger.

20. A system according to claim 19, wherein the overhead heat exchanger is a coil wound heat exchanger comprising one or more tube bundles contained within a shell and defining a tube side and a shell of the heat exchanger, wherein the shell side is the cold side of the heat exchanger and wherein the tube side is the warm side of the heat exchanger.

* * * * *